United States Patent [19]

Toepelt et al.

[11] 4,081,882

[45] Apr. 4, 1978

[54] LOCKING ZIPPER SLIDER, AND ZIPPER INCORPORATING SAID SLIDER

[75] Inventors: Werner Toepelt, Old Greenwich, Conn.; Richard Bernier, Uniondale, N.Y.

[73] Assignee: Coats & Clark, Inc., Stamford, Conn.

[21] Appl. No.: 738,161

[22] Filed: Nov. 1, 1976

[51] Int. Cl.[2] ..... A44B 19/26; E05B 67/38

[52] U.S. Cl. ..... 24/205 R; 24/205.15 R; 24/205.11 L; 70/68

[58] Field of Search ..... 24/205 R, 205.11 L, 24/205.15 R; 70/68; 190/41 Z

[56] References Cited

U.S. PATENT DOCUMENTS

| | | | |
|---|---|---|---|
| 1,919,966 | 7/1933 | Taylor | 70/68 |
| 2,398,947 | 4/1946 | Marinsky | 70/68 |
| 3,319,743 | 5/1927 | Pelavin | 70/68 |
| 3,944,032 | 3/1976 | Samhammer | 190/41 Z |
| 3,955,248 | 5/1976 | Akashi | 24/205.15 R |

FOREIGN PATENT DOCUMENTS

| | | | |
|---|---|---|---|
| 779,719 | 4/1935 | France | 24/205.15 R |

*Primary Examiner*—Bernard A. Gelak
*Attorney, Agent, or Firm*—Burgess, Ryan and Wayne

[57] ABSTRACT

A zipper has a pair of independently movable sliders, each of the sliders having a pull. The pulls have apertures through which U-shaped projections from the sliders extend, in order to loosely pivotally capture the pulls. The apertures of the pulls are elongated, so that the aperture may fit over the U-shaped projection of the other slider. Locking holes are provided extending through the U-shaped projections. The apertures of the pulls have unbroken edges, to maintain the strength of the pulls.

9 Claims, 5 Drawing Figures

LOCKING ZIPPER SLIDER, AND ZIPPER INCORPORATING SAID SLIDER

This invention relates to zippers of the type having two sliders which act independently of one another, and the invention is more particularly directed to improvements in the sliders for such zippers, wherein the sliders may be locked together.

Double slider zippers are well known, wherein the two sliders act independently of one another, and can be drawn together to effect the full closure of the zipper. For example, zippers of this type have been employed frequently as closure members for suitcases.

In such use, it is frequently desirable to be able to lock the zippers, and for this purpose, each of the sliders is provided with an upstanding projection with a hole extending transversely therethrough. The pulls for the sliders are fashioned so that they may overlap one another, atop either of the sliders, whereby the projection on the slider may extend through the apertures in each of the pulls to expose the hole in the projection. The projection and the hole therethrough on each of the sliders is of adequate size to enable insertion of the shank of a lock, such as a padlock or combination lock, therethrough. As a consequence, the sliders may be locked together. While the locking of the sliders together may not inhibit movement of the sliders on the zipper, it will necessitate moving of the sliders together, so that the zipper will remain fully closed regardless of the actual position of the interlocked sliders.

In the formation of sliders for this type of zipper, the slider is generally formed with a U-shaped upstanding projection having a central web. The formation of the slider may be effected, for example, by die casting or the like. In this case, the pull for the slider will be formed with a first aperture extending to one edge thereof, so that the aperture may be inserted over the U-shaped projection and crimped in place. The ends of the crimped in place aperture thus will lie adjacent the web of the U-shaped projection, with the edges of the projection holding the pull thereto while permitting it to be moved freely in a plane generally parallel to the web of the projection.

Alternatively, the web of the projection may be omitted, so that the edges of the first aperture of the pull are pressed together. This of course results in a weakened structure, and is not preferred.

It is apparent that the necessary crimping step required, for holding the pull to the slider, is undesirable, since it results in deformation marks on the pull that are generally clearly visible even after final finishing of the pull.

In the formation of a locking zipper of the above type, it is necessary to also provide the pull with a second aperture, positioned so that it may be inserted over the locking projection of the other slider. It would not suffice to employ the first aperture for this purpose, since the first aperture is weakened due to the necessity for it being formed as an open aperture, and the combining of the two apertures, if they are to be of the necessary size and strength, would thereby result in an excessively weak or excessively large pull. Due to the consequent necessity for a bridge between the two apertures, the projection for locking the zipper must be spaced from the U-shaped restraining projection on the slider. This, of course, results in a necessary increase in the size of both the slider and the pull. In addition, in order to render easy closing of the zipper, the U-shaped projection of each slider should be on the end thereof facing the other slider. As a consequence, the locking projections are on the rear ends of the sliders, thereby necessitating even greater lengthening of the pulls so that each pull may be fitted to extend over the locking projection of the other slider.

The present invention is thereby directed to the provision of a double slider locking zipper that overcomes the above disadvantages of the known zippers of this type. Briefly stated, in accordance with the invention, each pull for the zipper is provided with a single elongated aperture, the edges of the aperture being completely closed, i.e., with no break therein for assembly purposes. In order to be able to assemble the pull to the slider, the U-shaped projection on the slider is joined to the slider at only one end thereof, whereby a small space exists between the other end of the U-shaped projection and the body of the slider. The pull may thereby be inserted through this gap between the other end of the U-shaped projection and the body of the slider, and the U-shaped projection pressed to narrow the gap sufficiently that the pull cannot be removed from the slider without deformation of the U-shaped projection. The pull is thereby held for free and loose movement with respect to the slider, as in previous arrangements. Since the assembly of the slider and pull did not require deformation of the pull, the undesirable markings of the pull are avoided, and a simple process for forming the assembly is provided. Since the U-shaped projection is cast or similarly formed as a unitary member with the slider, it has been found that the very slight deformation of this member necessary to capture the pull does not result in any visible deformation of the slider.

Since it is possible to form the pull with only a single aperture, the locking aperature on the slider may now be formed in the projection which also captures the pull. As a consequence, it is apparent that the length of the slider may be considerably reduced. Further, such location of the locking aperture on the slider places the locking aperture closer to the other slider, when the sliders of the double slider zipper are moved together. It is apparent that, as a result, the elongation of the aperture in the pull need not be as long as in the past to enable the pull to be fitted over the locking aperture of the other slider. Thereby, it is apparent that the arrangement in accordance with the invention enables shortening of the pulls of the sliders.

In order that the invention will be more clearly understood, it will now be disclosed in greater detail with reference to the accompanying drawings, wherein.

Figure 1:
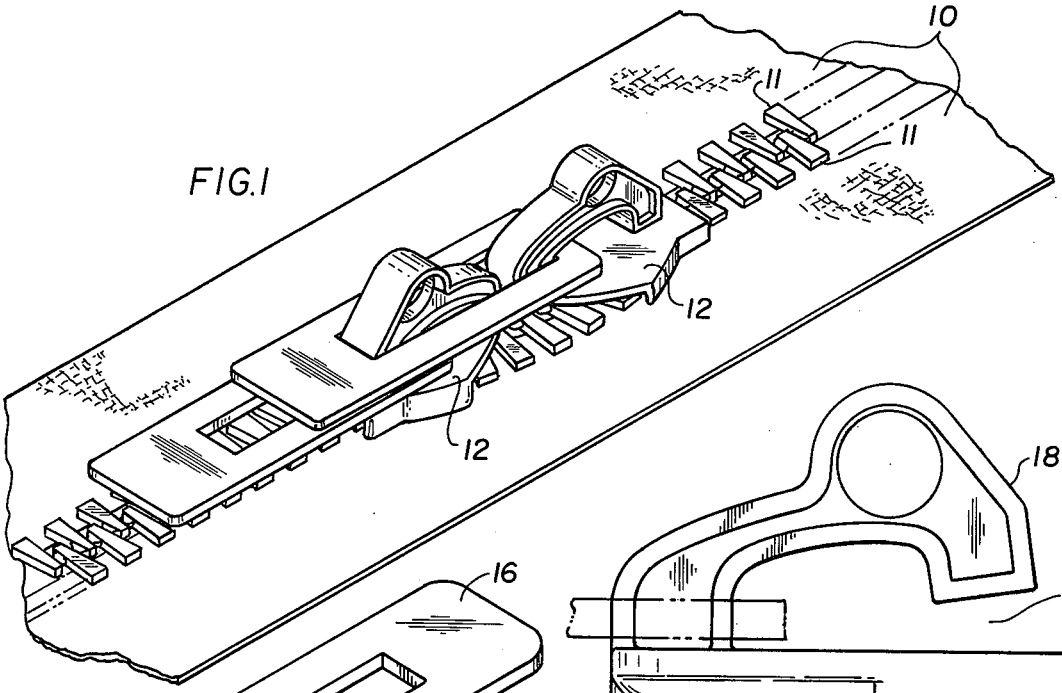
FIG. 1 is a perspective view of a portion of a double slider locking zipper in accordance with the invention.
Figure 3:
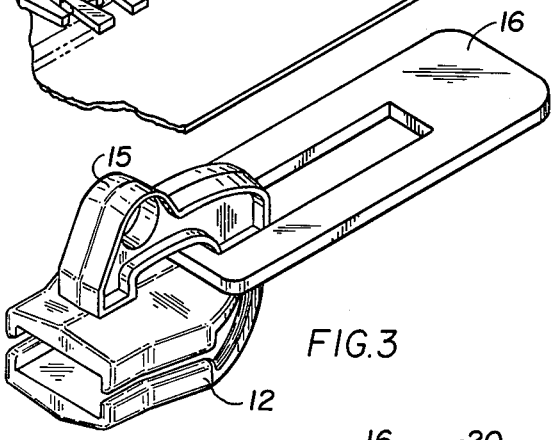
FIG. 3 is a perspective view of a slider-pull assembly for the zipper of FIG. 1.

Referring now to the drawings, and more in particular to FIG. 1, therein is illustrated a portion of a double slider locking zipper in accordance with the invention. The zipper is comprised of a pair of conventional zipper tapes 10 arranged in side by side relationship and having beaded edges to which conventional scoops 11 are affixed.

A pair of sliders 12 are mounted to slide along the scoops such that the scoops of adjacent tapes are interlocked on the sides of each slider away from the other slider, while the scoops between the two sliders are not interlocked and form an opening between the sliders.

The internal configuration of the sliders, for effecting the closing and opening of the zipper, is conventional, and hence need not be considered in detail in this disclosure. It will merely be noted that the sliders have ends 13, which are herein arbitrarily designated as leading ends, directed toward the opening or non-interlocked scoops, and ends 14 herein designated as trailing ends toward the adjacent interlocked scoops.

As seen in FIGS. 1–5, each of the sliders 12 is provided with a projection 15 for holding a pull 16. The projection 15 are generally inverted U-shaped elements, as more clearly appears in FIG. 2, with one arm 17 thereof being affixed to the base of the slider 12, at the leading edge 13 thereof. The other arm in the completed zipper may be spaced from or contact the base of the slider, but, if there is a gap, the gap is of inadequate width for the pull to pass therethrough.

The pull 16 of the zipper has a central hole or aperture 20. This hole is preferably stamped, punched, or otherwise formed in the pull 16, so that the metal or other material of the pull is continuous at the periphery of the hole. The absence of any breaks in the material surrounding the aperture of course strengthens the pull.

The pull 16 is assembled to the slider 12, as appears in FIGS. 1–4, with the U-shaped projection 15 extending through the aperture 20. Since, as discussed above, the gap between the arm of the projection 15 and the slider body toward the trailing edge of the slider is smaller than the thickness of the pull, the pull 16 is consequently captured by the slider. The aperture 20 is elongated, however, and the projection 15 extends in a plane generally normal to the plane of the tapes 10 and extending lengthwise of the zipper. As a consequence, and since the aperture fits the projection somewhat loosely, the pull may be readily moved in a generally arcuate locus in the plane of the projection.

Figure 5:
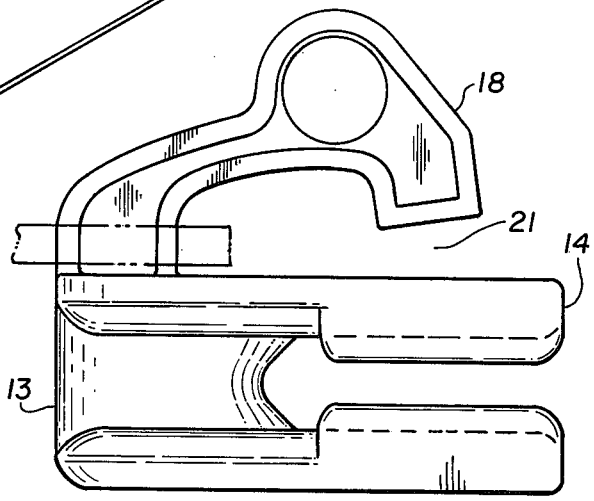
FIG. 5 is a side view of the slider of FIG. 3, prior to the capture of the pull thereon.
Figure 4:
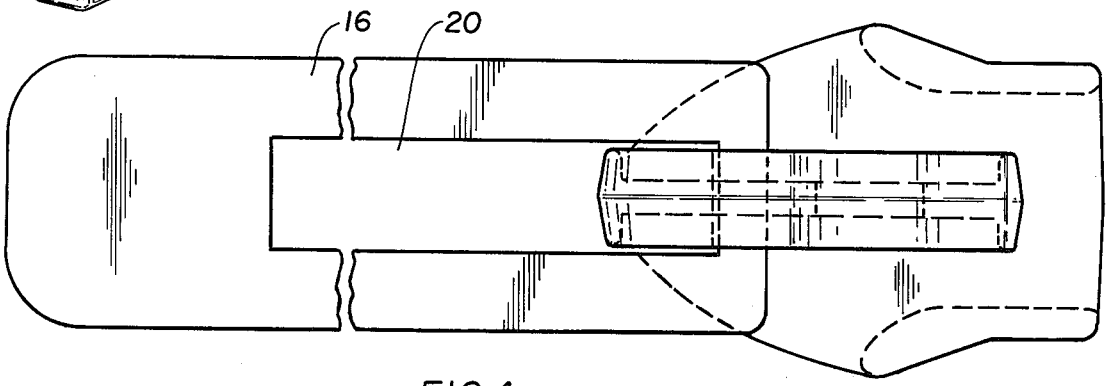
FIG. 4 is a top view of the slider assembly of FIG. 3.

In order to enable the capture of the pull by the slider, in the above manner, the slider 12 may be initially formed, as illustrated in FIG. 5, with the free end 18 of the projection spaced from the base of the slider by a gap 21 of a width greater than the thickness of the pull. For example, the slider and projection may be formed as a unitary member, by die casting this unit from a conventional die casting material. Following the formation of the slider with the projection thereon, the projection of the slider may be merely slipped through the aperture 20 of a pull, following which pressure is applied to the projection, to deform the projection and reduce the width of the gap to the desired extent.

It has been found that this technique, which has been employed in the past for single acting zippers, does not result in any visible deformation of the projection, but does enable the simple and economical formation of the slider and the simple assembly of the pull and slider together. When this technique was employed in the past, however, for single acting zippers, the aperture of the pull was not elongated, but was merely of adequate size to enable the free movement of the pull on the slider.

Referring again to FIGS. 1–4, the projection 15 of each of the sliders is provided with a hole 25 extending transversely therethrough. In the specific embodiment of the invention illustrated in the Figures, the U-shaped projection 15 is defined by an outer thickened rim 26 extending around the periphery of the projection, the center of the projection being formed as a web 27 bounded by the thickened edge 26. The hole 25, which is hereinafter referred to as a locking hole, extends through the web 27.

Figure 2:
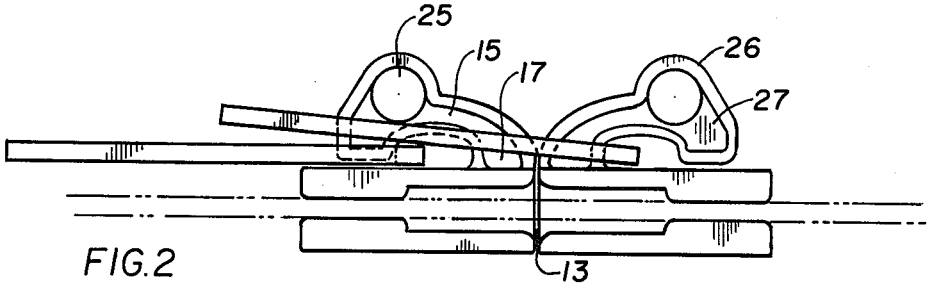
FIG. 2 is a side view of the zipper of FIG. 1.

As is especially apparent in FIG. 2, the locking aperture 25 is spaced above the base of the slider a distance at least equal to twice the thickness of a pull 16. The apertures 20 are sufficiently elongated, that, when pulled toward the leading end of the respective slider, the aperture may fit over the entire projection of the other slider, as shown in FIG. 2. As a consequence, if the pull of either of the sliders is positioned to extend toward the trailing end of the respective slider, and the pull of the other slider is fitted over the projection of the first mentioned slider, then it is apparent that the locking aperture of the first mentioned projection may be employed for the locking of the zipper. Specifically, the shank of a padlock (not shown) or the like may be extended through this locking aperture, so that the sliders cannot be separated.

In the arrangement of the invention, since the aperture 20 in the pull may be formed without a gap, the pull is of adequate strength without a bridge between a pair of apertures, that the aperture may be considerably elongated. As a consequence, it is not necessary, in accordance with the invention, to provide the locking aperture of the slider on a second projection from the base of the slider, so that the locking aperture may be provided on the same projection that serves to capture the pull. This of course enables the slider to have a considerably reduced length, since it is not necessary to form the locking aperture projection adjacent the trailing end thereof. It further results in a reduction in necessary lengths of the pull, since the aperture in the pull need no longer extend beyond the projection which captures the pull of the other slider. In addition, the overall height of the structure, in accordance with the invention, may be substantially the same as in the prior double slider locking zippers, since in either case it was necessary to extend the locking aperture above the base a distance equal to the thickness of two pulls. These advantages have been achieved without disadvantage of known arrangements, wherein the distortion of the pull, as a result of assembly of the pull through the slider, remained evident in the final structure.

In order to minimize the length of the pull, in accordance with the invention, it is of course necessary to minimize the length of the aperture therein. For this purpose, the U-shaped projections extend from the respective sliders as close as possible to the leading ends thereof. The pivoting apertures in the slider pulls may therefore have a minimum length substantially equal to the sum of the longitudinal dimension of the U-shaped projection, and the longitudinal dimension of the U-shaped projection at the end of the slider. The longitudinal direction is of course the longitudinal direction of the zipper itself. With such a minimum dimension, it is of course apparent that the aperture in each pull may readily extend completely over the U-shaped projection of the other slider.

While the invention has been disclosed and described with reference to a single embodiment, it will be apparent that variations and modifications may be made therein. For example, the form of the scoops of the zipper is immaterial to the invention, and the scoops may be of any conventional material. In addition, the invention is also adaptable to zippers of the type wherein no scoops are provided, the closure of the zipper depending upon engagement of longitudinally extending ridges on the zipper. It is therefore intended in the following claims to cover each such variation and modification as falls within the true spirit and scope of the invention.

What is claimed is:

1. In a slider assembly for a zipper, wherein the slider has a U-shaped projection with one arm thereof fixed to and extending from one face thereof at the leading edge of the slider, the other arm of the projection extending toward the trailing end of said slider, a slider pull having only a single aperture through which said projection extends, the other arm of said projection being spaced from said face a distance less than the thickness of said slider pull, whereby said pull is loosely held to said slider; the improvement wherein said aperture in said pull has a length greater than the lengthwise dimension of said U-shaped projection, and said U-shaped projection has a locking hole extending transversely therethrough.

2. The slider assembly of claim 1 wherein said aperture has a length substantially equal to the sum of the lengthwise dimension of said projection and the dimension of said one arm in the lengthwise direction of said zipper.

3. The slider assembly of claim 2 wherein said aperture has a width substantially equal to the width of said U-shaped projection.

4. The slider assembly of claim 1 wherein the leading end of said one arm of said projection is substantially aligned with the leading ends of said slider.

5. The slider assembly of claim 1, wherein said aperture of said pulls are holes extending through said pulls and having unbroken and unseparated edges.

6. The slider assembly of claim 5 wherein said sliders are of a die cast metal and said pulls are of sheet metal.

7. A double slider locking zipper, wherein a pair of sliders are mounted to slide independently of one another for opening and closing a common zipper, a pull is loosely pivoted to each slider, projection means having a locking hole is provided on each slider, each pull having only a single elongated aperture, whereby each pull may be moved so that its respective aperture fits over the projection of the other slider when the leading ends of the sliders are close to or engage one another, said projections comprising U-shaped projections having first arms extending from one face of the sliders at the leading ends thereof, the other arms of said U-shaped projections being spaced from said face of said slider a distance less than the thickness of said pulls, said locking holes extending transversely through said U-shaped projections, said U-shaped projections extending through said apertures of the respective pulls for loosely holding said pulls to the respective sliders.

8. The double slider locking zipper of claim 7 wherein said apertures in said pulls have lengths substantially equal to the sum of the lengthwise dimension of the respective U-shaped projection, and the lengthwise dimension of the arm of the respective U-shaped projection at the leading end of the respective slider.

9. The double slider locking zipper of claim 7 wherein the material of said pulls is unbroken and unseparated at the periphery of said apertures of said pulls.

* * * * *

UNITED STATES PATENT OFFICE

CERTIFICATE OF CORRECTION

Patent No. 4,081,882 Dated April 4, 1978

Inventor(s) Werner Toepelt, et al

It is certified that error appears in the above-identified patent and that said Letters Patent are hereby corrected as shown below:

Column 5, line 10: "fixed" should be --affixed--.

Signed and Sealed this

*Third* Day of *October 1978*

[SEAL]

*Attest:*

RUTH C. MASON
*Attesting Officer*

DONALD W. BANNER
*Commissioner of Patents and Trademarks*